US005740617A

United States Patent [19]

Rittenhouse

[11] Patent Number: 5,740,617

[45] Date of Patent: Apr. 21, 1998

[54] ROTARY DRUM DRYER

[76] Inventor: Norman P. Rittenhouse, 1001 N. First St., Fairbury, Ill. 61739

[21] Appl. No.: 842,389

[22] Filed: Apr. 23, 1997

[51] Int. Cl.[6] ..... F26B 7/00

[52] U.S. Cl. ..... 34/381; 34/385; 34/499

[58] Field of Search ..... 34/135, 381, 384, 34/385, 499, 503, 504

[56] References Cited

U.S. PATENT DOCUMENTS

| | | | |
|---|---|---|---|
| 1,250,427 | 12/1917 | Campbell | 34/385 X |
| 2,044,744 | 5/1936 | Hansen | 34/504 |
| 2,890,942 | 6/1959 | Webster et al. | 34/385 X |
| 4,067,119 | 1/1978 | Overton | 34/384 |
| 5,373,647 | 12/1994 | Bernes et al. | 34/385 X |
| 5,561,927 | 10/1996 | Ratajczek | 34/384 |

FOREIGN PATENT DOCUMENTS

| | | | |
|---|---|---|---|
| 624812 | 6/1949 | United Kingdom | 34/385 |
| 852525 | 10/1960 | United Kingdom | 34/385 |

*Primary Examiner*—Christopher Kilner
*Attorney, Agent, or Firm*—Philip L. Bateman

[57] ABSTRACT

A rotary drum dryer dries a slurry into discrete solid particles. The dryer contains three long horizontal cylinders: an outer cylinder, a perforated cylinder inside the outer cylinder, and an inner cylinder inside the perforated cylinder. As the cylinders rotate, slurry in the outer cylinder is compressed through the perforated cylinder by the inner cylinder and deposited onto the inner wall surface of the outer cylinder in discrete masses. The masses are dried as the cylinder rotates and then are removed by a scraper and conveyed outside the dryer for further treatment and/or packaging.

10 Claims, 1 Drawing Sheet

ROTARY DRUM DRYER

FIELD OF THE INVENTION

This invention relates to drying. More particularly, this invention relates to a rotary drum dryer for drying slurries and to a method of drying slurries.

BACKGROUND OF THE INVENTION

The drying of slurries is a common operation in manufacturing. The term "slurry" refers to an aqueous suspension. Many different types of dryers are used for drying slurries. According to the Chemical Engineer's Handbook (Robert H. Perry and Cecil H. Chilton, editors), there are three basic types of dryers. The first type of dryers are direct dryers, also known as convection dryers. Direct dryers feature a direct contact between the slurry and hot gases. The water evaporating from the slurry is carried away by the hot gases. An example of a direct dryer is a rotary dryer in which the slurry is conveyed and showered inside a rotating cylinder through which hot gas flows, as disclosed in Papafingos et al., U.S. Pat. No. 4,090,916, issued May 23, 1978. Direct dryers typically transform slurries into dry powders.

The second type of dryers are indirect dryers, also known as conduction or contact dryers. Indirect dryers are characterized by the transfer of heat to the slurry through a retaining wall. The water vapor is removed independently of the heating medium. An example of an indirect dryer is a drum dryer in which a slurry is coated onto the outside of a hot, rotating cylinder and then scraped off, as disclosed in DeBoel et al., U.S. Pat. No. 4,654,268, issued Mar. 31, 1987. Continuous sheets of material like paper and cellophane are often produced with these dryers.

The third type of dryers are radiant-heat dryers that involve the generation, transmission, and absorption of infrared radiation. Radiant-heat dryers are used less frequently than direct dryers and indirect dryers for drying slurries.

The type of dryer used affects the physical characteristics and particle size of the dry product. As previously mentioned, direct dryers produce a relatively fine powder whereas indirect dryers produce a sheet. Other dryers produce a mixed particle sizes. However, no dryers are available that produce a firm product having a uniform particle size in the range of about 0.1 to 2 cm.

SUMMARY OF THE INVENTION

The general objects of this invention are to provide an improved dryer and an improved method of drying slurries. More particular objects are to provide a dryer and a method that transform a slurry into a dry firm product having a uniform particle size in the range of about 0.1 to 2 cm.

I have invented an improved rotary drum dryer for drying a slurry into discrete solid masses. The dryer comprises: (a) a long horizontal outer cylinder with a smooth interior wall surface adapted to hold a quantity of a slurry at a particular level in its lower portion; (b) a long horizontal perforated cylinder inside the outer cylinder, the longitudinal axis of the perforated cylinder being: (i) parallel to the longitudinal axis of the outer cylinder; (ii) a distance away from the outer cylinder of about the radius of the perforated cylinder so that little or no gap exists between the perforated cylinder and the outer cylinder; and (iii) in a plane defined by the longitudinal axis of the outer cylinder and the line formed by the intersection of the top of the slurry and the outer cylinder; and (c) a long horizontal inner cylinder with a smooth exterior wall surface inside the perforated cylinder, the longitudinal axis of the inner cylinder being: (i) parallel to the longitudinal axes of the outer cylinder and the perforated cylinder; (ii) a distance away from the perforated cylinder of about the radius of the inner cylinder so that little or no gap exists between the inner cylinder and the perforated cylinder; and (iii) in a plane defined by the longitudinal axis of the outer cylinder and the line formed by the intersection of the top of the slurry and the outer cylinder; the inner cylinder adapted to compress the slurry through the perforations in the perforated cylinder and to deposit the compressed slurry as discrete masses on the interior wall surface of the outer cylinder.

The dryer further comprises: (d) a motor and speed reducer for rotating the outer cylinder; (e) an inlet pipe for introducing slurry into the outer cylinder; (f) a source of hot, dry air for flowing through the outer cylinder; (g) a scraper along the length of the outer cylinder for removing the dried discrete masses from the interior wall surface of the outer cylinder, the scraper being located opposite the perforated cylinder and above the slurry level so that the discrete masses are dried on the interior surface of the outer cylinder for at least about one-half of a rotation of the outer cylinder; and (h) a conveyor for transporting the dried, removed discrete solid masses from the outer cylinder.

The rotary drum dryer of this invention transforms a slurry into a dry firm product having a uniform particle size in the range of about 0.1 to 2 cm. The dryer handles a wide variety of slurries and is easy and economical to operate.

DETAILED DESCRIPTION OF THE INVENTION

1. The Invention In General

Figure 1:
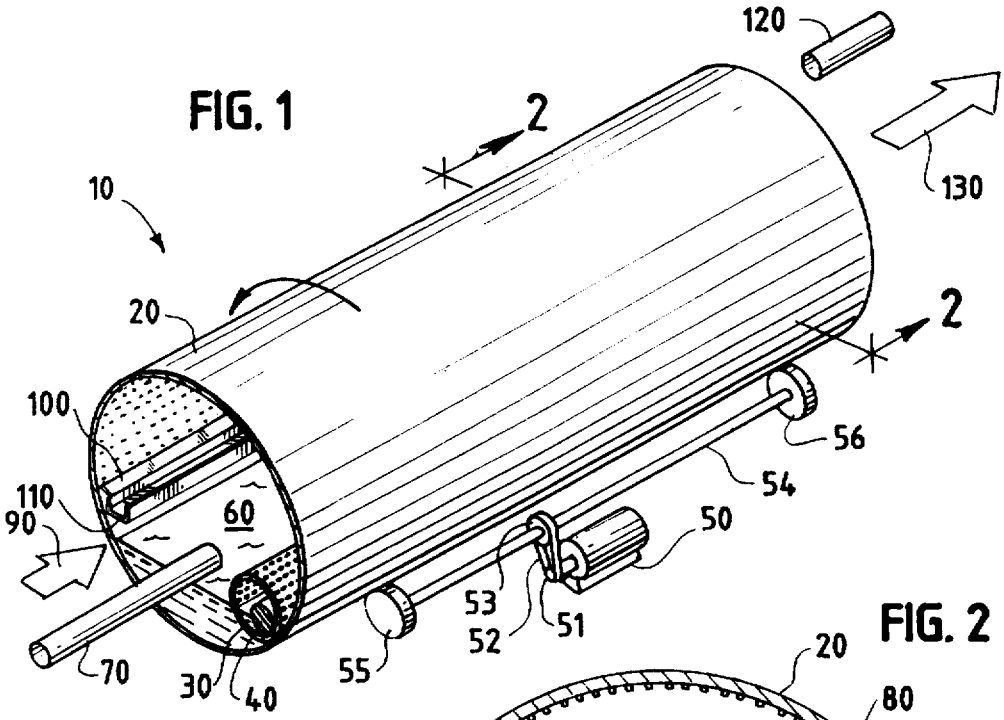
FIG. 1 is a front and side perspective view of the preferred embodiment of the rotary drum dryer of this invention with the front removed for clarity.

This invention is best understood by reference to the drawings. The rotary drum dryer 10 includes three long, horizontal cylinders: an outer cylinder 20, a perforated cylinder 30, and an inner cylinder 40. The outer cylinder is rotated in a counter-clockwise direction (when viewed from the front) by a motor 50 and speed reducer. A slurry 60 is fed into the outer cylinder through inlet pipe 70 to maintain a constant slurry level in the bottom of the outer cylinder. The rotating outer cylinder causes the perforated cylinder and the inner cylinder to rotate. As they rotate, the slurry is compressed through the perforations and is deposited as discrete masses 80 on the inner wall of the outer cylinder. Hot air 90 is blown through the cylinder to dry the masses as the cylinder rotates. The dried masses are removed from the wall by scraper 100 and drop onto conveyor 110. The dried masses are removed from the rotary drum dryer and transported for further treatment and/or packaging through line 120. The exhaust air 130 is vented to the atmosphere.

2. The Outer Cylinder

The outer cylinder has a length of about 2 to 20 m and has a diameter of about 1 to 5 m. Other things being equal, the drying capacity of the dryer increases as the size of the dryer increases. The outer cylinder is made primarily or completely of metal and has a wall thickness of about 0.2 to 2 cm. The interior wall surface of the outer cylinder may be lined or unlined and is made of a non-rusting material such as stainless steel, plastic, or the like. The interior wall surface is preferably even so that the discrete solid masses deposited upon it are uniform in size. The interior may be completely smooth or may have some roughness for better adherence of the discrete masses.

The outer cylinder is rotated by the motor and speed reducer, which are discussed in detail below. The rotational speed of the outer cylinder is a matter of choice. As the rotational speed increases, the quantity of slurry dried increases, but the drying time decreases. The outer cylinder typically rotates at a speed of about 0.2 to 2 rpm.

The outer cylinder is adapted to hold a quantity of slurry. The slurry level at its deepest point is about 0.1 to 0.5 times the radius of the outer cylinder. The slurry level remains constant during operation of the dryer. In other words, the incoming flow of slurry is equal to the rate at which the slurry is deposited onto the inner wall surface of the outer cylinder. It is desirable to aerate or mix the slurry in the outer cylinder to maintain a uniform composition.

3. The Perforated Cylinder

Figure 3:
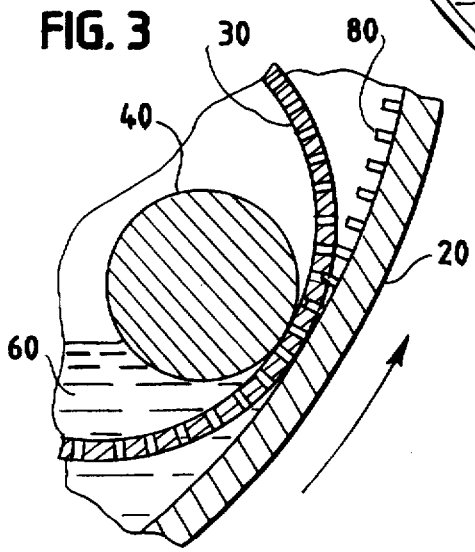
FIG. 3 is a detail of one portion of FIG. 2.

The perforated cylinder is located inside the outer cylinder. The longitudinal axis of the perforated cylinder is parallel to the longitudinal axis of the outer cylinder. The perforated cylinder is positioned so there is little or no gap between it and the outer cylinder. Stated differently, the longitudinal axis of the perforated cylinder is a distance away from the outer cylinder of about the radius of the perforated cylinder. The contact between the perforated cylinder and the outer cylinder is best seen in FIG. 3.

Figure 2:
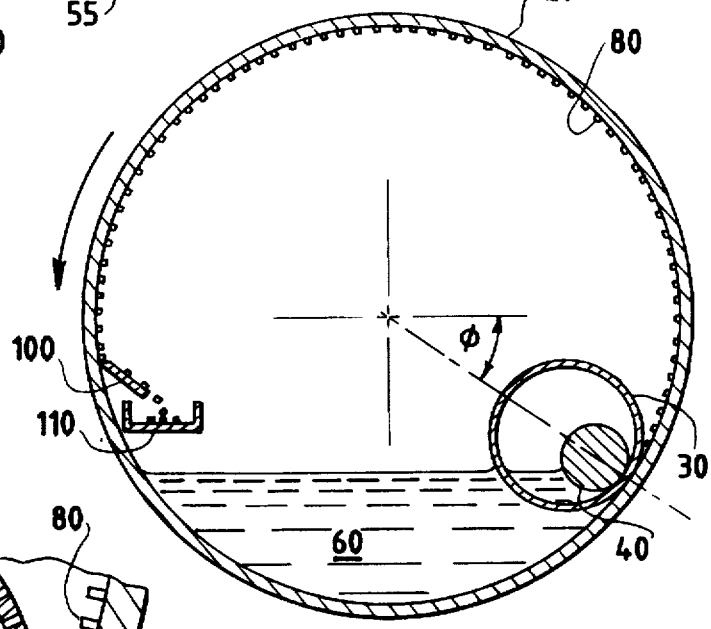
FIG. 2 is a sliced sectional view thereof taken along plane 2—2 of FIG. 1.

As seen in FIG. 2, the longitudinal axis of the perforated cylinder is located in the lower half of the outer cylinder. The longitudinal axis is located in a plane defined by the longitudinal axis of the outer cylinder and the line formed by the intersection of the top of the slurry and the outer cylinder. The term "in a plane" includes small variations of about 5 degrees or less. Again referring to FIG. 2, the longitudinal axis of the perforated cylinder is located at an angle $\emptyset$ below the horizontal. This location ensures that the point of contact between the perforated cylinder and the outer wall coincides with the slurry level.

The perforated cylinder has about the same length as the outer cylinder and has a diameter about 0.05 to 0.4, preferably about 0.1 to 0.3, times the diameter of the outer cylinder. The perforated cylinder has a wall thickness of about 0.1 to 2 cm, preferably about 0.2 to 1 cm. The thickness of the perforated cylinder determines the depth of the discrete masses of slurry deposited on the interior wall surface of the outer cylinder. If the thickness is less than about 0.1 cm, the masses are so shallow that the production rate is too low. If the thickness is greater than about 2 cm, there is a danger that the masses will lose their shape.

The perforations have a diameter of about 0.1 to 2 cm, preferably about 0.5 to 1.5 cm. The diameter of the perforations determines, of course, the diameter of the discrete masses deposited on the inner wall of the outer cylinder. The perforations have a constant diameter or are slightly larger at the outer surface to facilitate the disengagement of the discrete masses from the perforated cylinder. If desired, compressed air can be injected at the point of contact to further facilitate the disengagement. The perforations make up about 20 to 80, preferably about 30 to 70, percent of the area of the perforated cylinder.

The perforated cylinder is generally made of a rust-proof material. The preferred materials are stainless steel and plastics, such as polyvinylchloride. The perforated cylinder is preferably freely rotatable, i.e., the rotation of the outer cylinder causes the perforated cylinder to rotate. The perforated cylinder can be connected to a separate motor and a speed reducer, but it is generally unnecessary and undesirable.

4. The Inner Cylinder

The inner cylinder is located inside the perforated cylinder. The longitudinal axis of the inner cylinder is parallel to the longitudinal axes of the perforated cylinder and the outer cylinder. The inner cylinder is positioned so there is little or no gap between it and the perforated cylinder. Stated differently, the longitudinal axis of the inner cylinder is a distance away from the perforated cylinder of about the radius of the inner cylinder. This position of the inner cylinder relative the perforated cylinder provides the most effective compression of the slurry through the perforations.

The longitudinal axis of the inner cylinder is located in a plane defined by the longitudinal axis of the outer cylinder and the line formed by the intersection of the top of the slurry and the outer cylinder. This position places the point of contact between the inner cylinder and the perforated cylinder at the slurry level. As can be seen in FIG. 2, the longitudinal axes of the inner cylinder and the perforated cylinder are located in this same plane.

The inner cylinder has about the same length as the outer cylinder and has a diameter about 0.1 to 0.7, preferably about 0.3 to 0.5, times the diameter of the perforated cylinder. The inner cylinder has a continuous smooth exterior surface for compressing the slurry through the perforated cylinder. The inner cylinder is generally made of a rust-proof material such as stainless steel, either with or without an exterior plastic lining. Like the perforated cylinder, the inner cylinder is preferably freely rotatable. The rotation of the outer cylinder causes both the perforated cylinder and the inner cylinder to rotate.

5. Other Components

In addition to the three cylinders, the rotary drum dryer of this invention contains several other components. The motor and speed reducer rotate the outer cylinder. In the preferred embodiment shown in FIG. 1, the speed reducer consists of a pulley 51 mounted on the drive shaft of the motor, a drive belt 52, and a pulley 53 mounted on a shaft 54 that runs most of the length of the outer cylinder. Rubber wheels 55 and 56 are mounted on the shaft. The rubber wheels are turned by the motor and speed reducer and, in turn, support and rotate the outer cylinder. A variety of other speed reducing and drive mechanisms are widely known for rotating cylindrical dryers and all of these are suitable.

Another component of the dryer is an inlet pipe for introducing slurry into the outer cylinder. The rotary dryer preferably contains a level controller to ensure that the slurry level in the outer cylinder remains constant. A variety of level controllers, including floats and weight sensors, are known in the art and are suitable for this purpose.

Hot dry air is blown through the interior of the dryer to dry the discrete masses of slurry deposited on the interior wall surface of the outer cylinder. Gases other than air are suitable, but air is typically the gas of choice because it is freely available. The air is generally heated to a temperature of about 100° to 200° C. with a relative humidity of less than about 5 percent. The air can be heated by solar heat, by a burning fuel, by electrical energy, or in a variety of other ways. Efficiency is improved if the ambient air is first pre-heated in a heat exchanger with the air leaving the dryer. The air flow rate is a matter of choice. Other things being equal, the drying rate increases as the air flow rate increases. The air flow rate is generally about equal to the volume of the outer cylinder per 3 to 30 seconds. For example, if the volume of the outer cylinder is 100 $m^3$, the air flow rate is generally about 200 to 2,000 $m^3$ per minute.

The air used for drying is typically vented to the atmosphere, either immediately upon exiting the dryer or, if one is used, upon leaving the ambient air heat exchanger. However, if desired, the air can be cooled or otherwise treated to recover a portion of the evaporated liquid. Although the dryer is typically operated at atmospheric pressure, a vacuum can be applied to the dryer if the liquid to be evaporated has a low vapor pressure or if it is desirable to increase the rate of evaporation.

A scraper for removing the dried discrete masses is located along the length of the outer cylinder. The scraper is located opposite the perforated cylinder and above the slurry level, as shown in FIG. 2. This position provides for maximum drying time for the masses. As can be seen, the masses are dried on the outer cylinder for more than one-half (180°) of the rotation. After the discrete masses are removed by the scraper, they drop onto a conveyor that transports the material from the outer cylinder. Suitable conveyors include belts, screw conveyors, and the like.

6. Slurry And Product Compositions

A wide variety of slurries are advantageously dried in the rotary drum dryer of this invention. In general, the slurries have a solids content of about 5 to 75, preferably about 10 to 50, percent by weight. If the solids content is less that about 5 percent, the slurry is so watery that it does not form discrete masses when compressed through the perforated cylinder. The minimum solids level is self-regulating to some extent because the discrete masses fall back into the slurry if they are too wet. If the solids content is greater than about 75 percent, the slurry is so viscous that it is difficult to pump and to compress through the perforated cylinder. If necessary or desirable, the solids content of the slurry can be adjusted before the slurry is introduced to the dryer. The solids content is reduced by adding water and the solids content is increased by removing water (by decanting, evaporation, centrifugation, or the like) and/or by adding solids. For example, the addition of zeolites to the slurry increases the solids content and the viscosity of the slurry. Examples of slurries that can be dried in the dryer include fertilizers such as hog wastes, animal feeds, etc.

The dried slurry material from the rotary drum dryer generally has a moisture content of less than about 10 percent by weight. The material is in the form of discrete solid masses having a uniform particle size in the range of about 0.1 to 2 cm. The material can be packaged as is or can be subjected to further treatment. Even without further treatment, the material has many of the same advantages of pellets, namely, it is free-flowing, low in hygroscopicity, and can be distributed on fields without excessive dispersion in the wind.

7. Example

The following example is illustrative only. A rotary drum dryer of this invention was constructed as follows. The outer cylinder of the dryer was constructed of 10 gauge stainless steel and had a length of about 2 m and a diameter of about 2 m. The perforated cylinder was constructed from a length of polyvinylchloride (PVC) pipe having a diameter of about 20 cm and a wall thickness of about 6 mm. The pipe was drilled with equally spaced 1-cm-diameter holes to provide a surface area that was 50 percent perforations. The inner cylinder was a solid cylinder of stainless steel having a diameter of about 7 cm with a 1-cm-thick outer cover of polypropylene. The outer cylinder was rotated at about one rpm by a 0.2 horsepower motor operating through a chain sprocket and rubber wheels as shown in FIG. 1.

Hog wastes having a solids level of about 15 percent can be dried in the dryer to a moisture content of about 10 percent. Ambient air is heated by solar energy to a temperature of about 100° C. and then blown through the dryer at a flow rate of about 100 $m^3$ per minute. Air exiting the dryer is passed through a heat exchanger to pre-heat ambient air before being vented to the atmosphere. The dried hog wastes are in the form of firm particles that are advantageously used as fertilizer.

I claim:

1. A method of drying a slurry into discrete solid masses, the method comprising:

(a) introducing a slurry having a solids content of about 5 to 75 weight percent into a rotary drum dryer, the rotary drum dryer comprising: (i) a long horizontal outer cylinder with a smooth interior wall surface adapted to hold a quantity of a slurry at a particular level in its lower portion; (ii) a long horizontal perforated cylinder inside the outer cylinder, the longitudinal axis of the perforated cylinder being parallel to the longitudinal axis of the outer cylinder, a distance away from the outer cylinder of about the radius of the perforated cylinder so that little or no gap exists between the perforated cylinder and the outer cylinder, and in a plane defined by the longitudinal axis of the outer cylinder and the line formed by the intersection of the top of the slurry and the outer cylinder; and (iii) a long horizontal inner cylinder with a smooth exterior wall surface inside the perforated cylinder, the longitudinal axis of the inner cylinder being parallel to the longitudinal axes of the outer cylinder and the perforated cylinder, a distance away from the perforated cylinder of about the radius of the inner cylinder so that little or no gap exists between the inner cylinder and the perforated cylinder, and in a plane defined by the longitudinal axis of the outer cylinder and the line formed by the intersection of the top of the slurry and the outer cylinder;

(b) rotating the outer cylinder, the perforated cylinder, and the inner cylinder to compress the slurry through the perforations in the perforated cylinder and to deposit the compressed slurry as discrete masses on the interior wall surface of the outer cylinder;

(c) passing hot, dry air through the outer cylinder;

(d) removing the dried discrete masses from the interior wall surface of the outer cylinder; and (e) transporting the dried, removed discrete solid masses from the outer cylinder.

2. The method of claim 1 wherein the perforated cylinder and the inner cylinder are freely rotatable.

3. The method of claim 2 wherein the diameter of the perforated cylinder is about 0.005 to 0.4 times the diameter of the outer cylinder.

4. The method of claim 3 wherein the diameter of the inner cylinder is about 0.1 to 0.7 times the diameter of the perforated cylinder.

5. The method of claim 4 wherein the perforated cylinder has a wall thickness of about 0.1 to 2 cm and has perforations with a diameter of about 0.1 to 2 cm.

6. A rotary drum dryer for drying a slurry into discrete solid masses, the dryer comprising:

(a) a long horizontal outer cylinder with a smooth interior wall surface adapted to hold a quantity of a slurry at a particular level in its lower portion;

(b) a long horizontal perforated cylinder inside the outer cylinder, the longitudinal axis of the perforated cylinder being: (i) parallel to the longitudinal axis of the outer cylinder; (ii) a distance away from the outer cylinder of about the radius of the perforated cylinder so that little or no gap exists between the perforated cylinder and the outer cylinder; and (iii) in a plane defined by the longitudinal axis of the outer cylinder and the line formed by the intersection of the top of the slurry and the outer cylinder;

(c) a long horizontal inner cylinder with a smooth exterior wall surface inside the perforated cylinder, the longitudinal axis of the inner cylinder being: (i) parallel to the longitudinal axes of the outer cylinder and the perforated cylinder; (ii) a distance away from the perforated cylinder of about the radius of the inner cylinder so that little or no gap exists between the inner cylinder and the perforated cylinder; and (iii) in a plane defined by the longitudinal axis of the outer cylinder and the line formed by the intersection of the top of the slurry and the outer cylinder; the inner cylinder adapted to compress the slurry through the perforations in the perforated cylinder and to deposit the compressed slurry as discrete masses on the interior wall surface of the outer cylinder;

(d) a motor and speed reducer for rotating the outer cylinder;

(e) an inlet pipe for introducing slurry into the outer cylinder;

(f) a source of hot, dry air for flowing through the outer cylinder;

(g) a scraper along the length of the outer cylinder for removing the dried discrete masses from the interior wall surface of the outer cylinder, the scraper being located opposite the perforated cylinder and above the slurry level so that the discrete masses are dried on the interior surface of the outer cylinder for at least about one-half of a rotation of the outer cylinder; and (h) a conveyor for transporting the dried, removed discrete solid masses from the outer cylinder.

7. The rotary drum dryer of claim 6 wherein the perforated cylinder and the inner cylinder are freely rotatable.

8. The rotary drum dryer of claim 7 wherein the diameter of the perforated cylinder is about 0.005 to 0.4 times the diameter of the outer cylinder.

9. The rotary drum dryer of claim 8 wherein the diameter of the inner cylinder is about 0.1 to 0.7 times the diameter of the perforated cylinder.

10. The rotary drum dryer of claim 9 wherein the perforated cylinder has a wall thickness of about 0.1 to 2 cm and has perforations with a diameter of about 0.1 to 2 cm.

* * * * *